US006247865B1

(12) United States Patent
Russell et al.

(10) Patent No.: US 6,247,865 B1
(45) Date of Patent: Jun. 19, 2001

(54) MARKER DEVICE WITH ATTACHED CAP

(76) Inventors: Robert G. Russell; Beth C. Russell, both of 801 Boleyn Pl., Manchester, MO (US) 63021

( * ) Notice: Subject to any disclaimer, the term of this patent is extended or adjusted under 35 U.S.C. 154(b) by 0 days.

(21) Appl. No.: 09/591,053

(22) Filed: Jun. 9, 2000

(51) Int. Cl.[7] ..... B43K 9/00

(52) U.S. Cl. ..... 401/202; 401/98; 401/213; 401/243

(58) Field of Search ..... 401/202, 213, 401/98, 243, 262; D19/43, 51, 57

(56) References Cited

U.S. PATENT DOCUMENTS

D. 196,816 * 11/1963 Brody ..... D19/43
D. 319,662 * 9/1991 Henry ..... 401/202
D. 389,188 * 1/1998 Conforti et al. ..... 401/202
5,352,053 * 10/1994 Reitze ..... 401/202
5,590,971 * 1/1997 Melnick ..... 401/202

FOREIGN PATENT DOCUMENTS

2221872 * 2/1990 (GB) ..... 401/202
82/00614 * 3/1982 (WO) ..... 401/202

* cited by examiner

*Primary Examiner*—Charles R. Eloshway

(57) ABSTRACT

A marker device with attached cap for preventing the loss of caps for markers. The marker device with attached cap includes a marker having a body and a writing member disposed at a writing end thereof; and also includes a cap member removably disposed upon the writing member and being hingedly attached to the marker; and further includes a tether-like member having ends securely connected to the body of the marker and to a wall of the cap member; and also includes a cap attachment assembly for removably attaching the cap member to the body of the marker.

6 Claims, 1 Drawing Sheet

MARKER DEVICE WITH ATTACHED CAP

BACKGROUND OF THE INVENTION

1. Field of the Invention

The present invention relates to an attached cap for a marker and more particularly pertains to a new marker device with attached cap for preventing the loss of caps for markers.

2. Description of the Prior Art

The use of an attached cap for a marker is known in the prior art. More specifically, an attached cap for a marker heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,615,506; U.S. Pat. No. Des. 319,662; U.S. Pat. No. 4,090,647; U.S. Pat. No. 4,377,248; U.S. Pat. No. 4,036,357; and U.S. Pat. No. 3,781,122.

While these devices fulfill their respective, particular objectives and requirements, the aforementioned patents do not disclose a new marker device with attached cap. The inventive device includes a marker having a body and a writing member disposed at a writing end thereof; and also includes a cap member removably disposed upon the writing member and being hingedly attached to the marker; and further includes a tether-like member having ends securely connected to the body of the marker and to a wall of the cap member; and also includes a cap attachment assembly for removably attaching the cap member to the body of the marker.

In these respects, the marker device with attached cap according to the present invention substantially departs from the conventional concepts and designs of the prior art, and in so doing provides an apparatus primarily developed for the purpose of preventing the loss of caps for markers.

SUMMARY OF THE INVENTION

In view of the foregoing disadvantages inherent in the known types of attached cap for a marker now present in the prior art, the present invention provides a new marker device with attached cap construction wherein the same can be utilized for preventing the loss of caps for markers.

The general purpose of the present invention, which will be described subsequently in greater detail, is to provide a new marker device which has many of the advantages of the attached cap for a marker mentioned heretofore and many novel features that result in a new marker device with attached cap which is not anticipated, rendered obvious, suggested, or even implied by any of the prior art attached cap for a marker, either alone or in any combination thereof.

To attain this, the present invention generally comprises a marker having a body and a writing member disposed at a writing end thereof; and also includes a cap member removably disposed upon the writing member and being hingedly attached to the marker; and further includes a tether-like member having ends securely connected to the body of the marker and to a wall of the cap member; and also includes a cap attachment assembly for removably attaching the cap member to the body of the marker.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new marker device with attached cap which has many of the advantages of the attached cap for a marker mentioned heretofore and many novel features that result in a new marker device with attached cap which is not anticipated, rendered obvious, suggested, or even implied by any of the prior art attached cap for a marker, either alone or in any combination thereof.

It is another object of the present invention to provide a new marker device with attached cap which may be easily and efficiently manufactured and marketed.

It is a further object of the present invention to provide a new marker device with attached cap which is of a durable and reliable construction.

An even further object of the present invention is to provide a new marker device with attached cap which is susceptible of a low cost of manufacture with regard to both materials and labor, and which accordingly is then susceptible of low prices of sale to the consuming public, thereby making such marker device with attached cap economically available to the buying public.

Still yet another object of the present invention is to provide a new marker device with attached cap which provides in the apparatuses and methods of the prior art some of the advantages thereof, while simultaneously overcoming some of the disadvantages normally associated therewith.

Still another object of the present invention is to provide a new marker device with attached cap for preventing the loss of caps for markers.

Yet another object of the present invention is to provide a new marker device with attached cap which includes a marker having a body and a writing member disposed at a writing end thereof; and also includes a cap member removably disposed upon the writing member and being hingedly attached to the marker; and further includes a tether-like member having ends securely connected to the body of the marker and to a wall of the cap member; and also includes a cap attachment assembly for removably attaching the cap member to the body of the marker.

Still yet another object of the present invention is to provide a new marker device with attached cap that is easy and convenient to use and prevents markers from prematurely drying out because of lost caps.

Even still another object of the present invention is to provide a new marker device with attached cap that substantially lengthens the use of markers since they won't dry out as quickly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
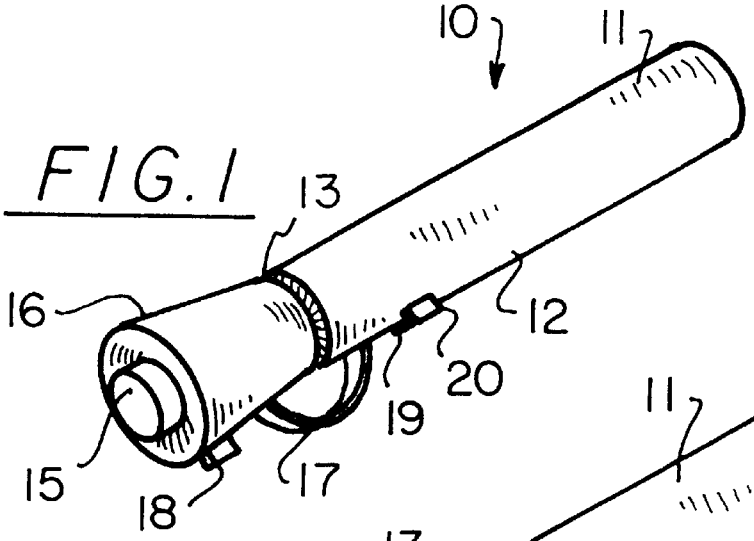
FIG. 1 is a perspective view of a new marker device with attached cap according to the present invention showing the cap member disposed upon the writing end of the marker.
Figure 2:
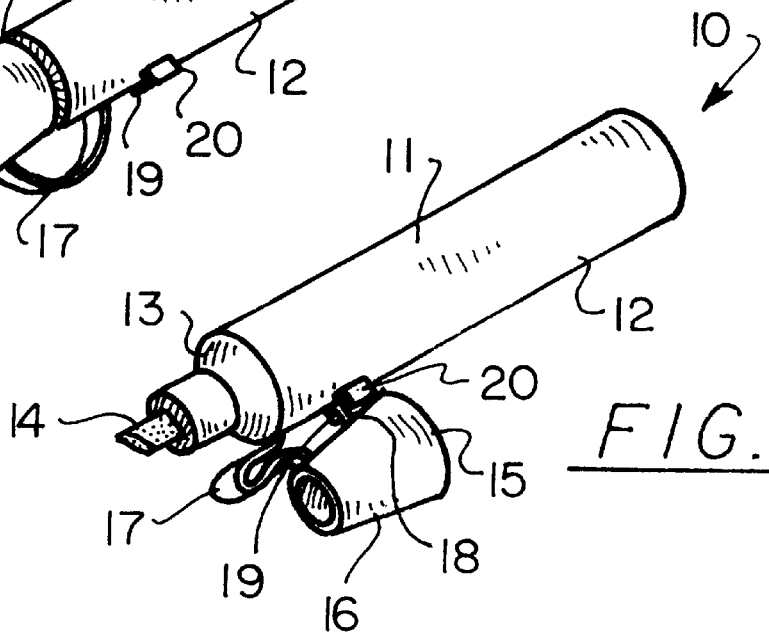
FIG. 2 is a perspective view of the present invention showing the cap member securely attached to the body of the marker.
Figure 3:
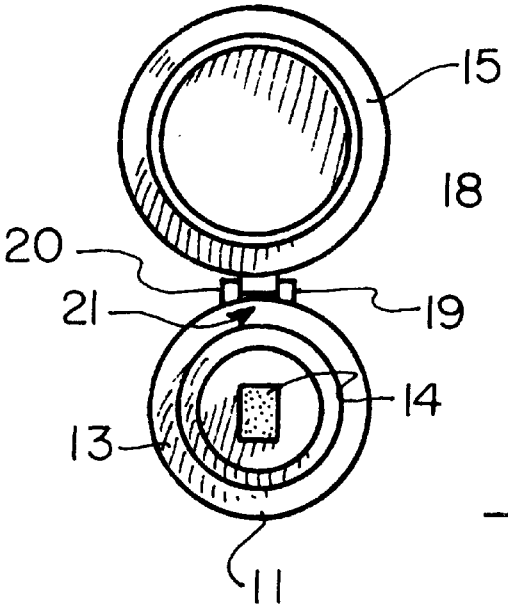
FIG. 3 is a top end plan view of the present invention with the cap member being securely attached to the body of the marker.

With reference now to the drawings, and in particular to FIGS. 1 through 3 thereof, a new marker device with attached cap embodying the principles and concepts of the present invention and generally designated by the reference numeral 10 will be described.

As best illustrated in FIGS. 1 through 3, the marker device with attached cap 10 generally comprises a marker 11 having a body 12 and a writing member 14 conventionally disposed at a writing end 13 thereof. A cap member 15 is removably disposed upon the writing member 14 and the writing end 13 and is hingedly attached to the marker 11. A tether-like member 17 having ends is securely and conventionally attached to the body 12 of the marker 11 and to a wall 16 of the cap member 15 with the tether-like member 17 being essentially a flexible member which is adapted to allow a user to flip the cap member 15 off and on the writing end 13 of the marker 11. A means for removably attaching the cap member 15 to the body 12 of the marker 11 includes a nib-like member 18 securely and conventionally disposed upon an exterior of the wall 16 of the cap member 15, and also includes a retaining member 19,20 securely and conventionally disposed upon an exterior of the body 12 of the marker 11 and being adapted to removably retain the nib-like member 18 upon the cap member 15 being removed from the writing end 14 of the marker 11. The retaining member 19,20 includes a pair of prong-like members 19,20 being spaced apart and forming a slot 21 therebetween and extending outwardly from the body 12 of the marker 11 with the slot 21 being adapted to engageably receive the nib-like member 18 for holding the cap member 15 when the cap member 15 is removed from the writing end 13 of the marker 11. The nib-like member 18 is disposed near a top end of the cap member 15, and the prong-like members 19,20 are disposed near the writing end 13 of the marker 11.

In use, the user can remove the cap member 15 from the marker 11 and attach the cap member 15 directly to the body 12 of the marker 11 while user the marker 11. Once finished using the marker 11, the user can simply disengage the cap member 15 from the body 12 of the marker 11 and securely cover the writing member 14 of the marker 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A marker device with attached cap comprising:

a marker having a body and a writing member disposed at a writing end thereof;

a cap member removably disposed upon said writing member and being hingedly attached to said marker;

a tether-like member having ends securely connected to said body of said marker and to a wall of said cap member;

attachment means for removably attaching said cap member to said body of said marker substantially adjacent said writing end; and wherein said tether-like member is flexible to permit bending of said tether-like member during removal of said cap from said writing end of said marker and during positioning of said cap member substantially adjacent said writing end.

2. A marker device with attached cap as described in claim 1, wherein said attachment means for removably attaching said cap member to said body of said marker includes a nib-like member securely disposed upon an exterior of said wall of said cap member, and also includes a retaining member securely disposed upon an exterior of said body of said marker and being adapted to removably retain said nib-like member upon said cap member being removed from said writing end of said marker.

3. A marker device with attached cap as described in claim 2, wherein said retaining member includes a pair of prong-like members being spaced apart and forming a slot therebetween said prong-like members extending outwardly from said body of said marker, said slot removably receiving said nib-like member for selectively holding said cap member against said body of said marker when said cap member is removed from said writing end of said marker.

4. A marker device with attached cap as described in claim 3, wherein said nib-like member is disposed near a top end of said cap member.

5. A marker device with attached cap as described in claim 4, wherein said prong-like members are disposed near said writing end of said marker.

6. A marker device with attached cap comprising:

a marker having a body and a writing member disposed at a writing end thereof;

a cap member removably disposed upon said writing member and being hingedly attached to said marker;

a tether-like member having ends securely connected to said body of said marker and to a wall of said cap member, said tether-like member being flexible which is adapted to allow a user to flip said cap member off and on said writing end of said marker;

attachment means for removably attaching said cap member to said body of said marker substantially adjacent said writing end including a nib-like member securely disposed upon an exterior of said wall of said cap member, and also including a retaining member securely disposed upon an exterior of said body of said marker and being adapted to removably retain said nib-like member upon said cap member being removed from said writing end of said marker, said retaining member including a pair of prong-like members being spaced apart and forming a slot therebetween, said prong-like members extending outwardly from said body of said marker, said slot removably receiving said nib-like member for selectively holding said cap member against said body of said marker when said cap member is removed from said writing end of said marker, said nib-like member being disposed near a top end of said cap member, said prong-like members being disposed near said writing end of said marker; and such that the flexibility of said tether-like member permits bending of said tether-like member during removal of said cap from said writing end of said marker and during positioning of said cap member substantially adjacent said writing end.

* * * * *